US005820734A

United States Patent [19]

Pantaleo et al.

[11] Patent Number: 5,820,734

[45] Date of Patent: Oct. 13, 1998

[54] TRAILING ELEMENT FOR A HEADBOX

[75] Inventors: Scott B. Pantaleo, Beloit, Wis.; Richard R. Hergert, Rockton, Ill.

[73] Assignee: Beloit Technologies, Inc., Wilmington, Del.

[21] Appl. No.: 57,290

[22] Filed: Apr. 8, 1998

[51] Int. Cl.[6] ..... D21F 1/06

[52] U.S. Cl. ..... 162/343; 162/336; 162/344; 162/374

[58] Field of Search ..... 162/343, 336, 162/374, 344

[56] References Cited

U.S. PATENT DOCUMENTS

| | | | |
|---|---|---|---|
| 4,566,945 | 1/1986 | Ewald et al. | 162/343 |
| 4,617,091 | 10/1986 | Rodal et al. | 162/343 |
| 5,013,406 | 5/1991 | Hergert | 162/343 |

*Primary Examiner*—Peter Chin
*Assistant Examiner*—Steven B. Leavitt
*Attorney, Agent, or Firm*—Raymond W. Campbell; David J. Archer

[57] ABSTRACT

A graphite composite trailing element for a headbox of a paper making machine is described. A protective layer is provided at or around pondside edges of a trailing element. The protective layer reinforces the pondside edges of the element to protect the edges from damage. The protective layer can also provide a protective sheath around the edges of the element to help prevent stock from being absorbed between the composites making up the elements. With reinforced edges and a protective sheath, the bonded composite sheets of the element are less susceptible to separation and delamination thereby resulting in an improved graphite composite trailing element. The protective layer can be made from any number of woven fiber glass mesh materials and is embedded in an epoxy base. The protective layer is compatible with the bonding and curing requirements of the composite sheets making up the trailing element.

9 Claims, 4 Drawing Sheets

TRAILING ELEMENT FOR A HEADBOX

BACKGROUND OF THE INVENTION

1. Field of the Invention

The present invention relates to a composite trailing element for a headbox of a paper making machine, and relates more particularly to reinforced edges at or around the pondside edges of the trailing element to protect the edges from damage, thereby protecting the element from tearing and delamination.

2. Description of the Prior Art

Freely movable self-positioning trailing elements in a slice chamber of a headbox are generally known to those skilled in the art. Beloit Corporation manufacturers and sells one such trailing element identified as a ConverFlo™ sheet for use in Beloit Corporation's Concept IV-MH™, Concept III™, Thin Channel ConverFlo™, ConverFlo™, and ConverFlo LS™ headboxes. The ConverFlo™ trailing elements of a headbox dampen or attenuate the scale of the turbulence of stock flowing through a headbox. Each of the trailing elements is pivotally anchored at an upstream end of a slice chamber and respective downstream ends of the trailing elements freely float within the slice chamber. The outer edges of the slice chamber are set by left and right pondsides of a headbox. Typically, trailing elements extend from pondside to pondside.

Trailing elements are capable of generating and/or maintaining fine scale turbulence in a paper stock flowing toward and through a slice opening found at the end of a slice chamber. As the stock passes through the slice chamber in a converging path towards the slice opening or slice-lip thereof, the trailing elements are permitted to move relative to each other, thereby dampening or attenuating the scale of turbulence within the headbox so as to achieve micro-turbulence within the ejected stock. Such micro-turbulence assists in providing a more uniform web by preventing individual fibers from forming flocs. Additionally, such micro-turbulence maintains a more uniform basis weight across the width of the resultant web by preventing cross-flows of the fibers in the stock.

U.S. Pat. Nos. 4,566,945 and 4,617,091 describe particular trailing element designs. As used herein, machine direction will refer to a flow direction of stock flowing through a headbox, and cross-machine direction is a flow direction at right angles thereto. The '945 patent describes a trailing element which has different flexure physical qualities from an upstream end to a downstream end, and these are obtained as a result of the trailing element being constructed of laminated sheets or plies. The '091 patent describes a trailing element which has a greater structural stiffness (preferably at a downstream tip) in the cross-machine direction than in the machine direction, and in a preferred form which is made of an anisotropic material, preferably on being formed of a laminate with separate layers of the laminate providing the qualities of cross-machine stiffness and machine direction strength and flexibility by either material properties, direction, size or number of layers. Alternates of woven or needled material with weave direction or materials, or size or number of filaments controlling directional stiffness are described in both patents.

U.S. Pat. No. 5,013,406 describes an improved trailing element over the trailing elements of the above-mentioned patents.

The '406 patent describes a trailing element made up of a plurality of sheets bound together and having an upstream bead which extends in a cross-machine direction within a headbox. The bead is described as being anchored within a slot defined by the headbox such that the bead is permitted to pivot within the slot, so that a downstream end of the trailing element is permitted to freely float within the headbox for attenuating the turbulence within the headbox. The improvement found in the '406 patent resides in providing a wear resistant cladding means to the upstream bead for inhibiting wear and fracturing of the sheets caused by frictional engagement between the trailing element device and the slot.

Many trailing elements are made of an inert material, such as polycarbonate resin sheet material, that will not be damaged by normal stock or temperature conditions. A polycarbonate resin sheet material known to those skilled in the art is referred to as a Lexano sheet. Lexan® is a registered trademark of the General Electric Company. However, these polycarbonate sheets are susceptible to damage during cleaning of a headbox when using boilout procedures or chemical solvent cleaning solutions. Since the polycarbonate elements are not capable of withstanding chemical cleaning procedures and because the polycarbonate elements can be damaged while cleaning the headbox with a high pressure or temperature hose, the polycarbonate sheets should be removed during cleaning of a headbox. Removing these polycarbonate sheets involves considerable time and expense.

Graphite fiber composite trailing elements were created to combat the problems associated with using polycarbonate sheets. The graphite composite trailing elements can be left in the headbox during chemical cleaning procedures, unlike polycarbonate trailing elements. An added benefit of the composite design is the strength of the element as compared to the strength of polycarbonate elements. The stronger composite design increases the likelihood of the elements surviving for longer periods of time within the harsh environment found within a pulp and paper mill and, particularly, a paper making machine. Although polycarbonate elements are still made for use today, the subject of the present invention is directed only towards graphite composite elements and improving the life expectancy of such graphite composite elements.

Generally, a graphite composite trailing element is of rectangular configuration and made up of a plurality of sheets bound together. The sheets are staggered relative to each other such that the trailing element is tapered with the element decreasing in thickness from an upstream end towards a downstream end. The binding means is an epoxy resin and the outer surfaces of a trailing element are generally coated with an epoxy resin for imparting smoothness to the element. Typically, a trailing element includes graphite fiber composites within the range of 50 to 70 percent by weight and epoxy resin within the range of 30 to 50 percent by weight. When attaching composite sheets to each other by way of epoxy, the composite sheets are provided with excess material in the cross-machine direction which material is then trimmed off once the entire element is assembled.

It has been found through field experience that the life expectancy of a composite element is directly related to material handling problems resulting in sheet damage. Sheet damage is frequently found at the machine direction edges of a sheet near the pondsides of a headbox.

The most common failure of a graphite composite trailing element is from delamination of the sheets or plies of construction. The edges, near the headbox pondsides are the most susceptible to this delamination. Once an edge is damaged, delamination generally begins. Once a ply starts to delaminate, a result of the edges of the sheets being structurally damaged, the strength of the trailing element decreases. Delamination will also cause a flow disruption in a headbox and paper fiber hang-up leading to machine runnability problems, resulting in a poor final paper product.

What is needed is a new trailing element which eliminates the heretofore mentioned problems. What is needed is a trailing element which is not susceptible to edge damage. Such a trailing element must be able to withstand handling mishaps and increase its field life more than heretofore obtained. Additionally, what is further needed is a trailing element that is less susceptible to delamination at its edges thereby maintaining its strength and preventing flow disruption in a headbox.

SUMMARY OF THE INVENTION

The solution to providing a composite trailing element with reinforced edges to protect the edges from damage which results in delamination of the plies making up the element, resides in providing a protective layer at or around the pondside edges of the trailing member. The protective layer can be made from any number of woven fiber glass mesh materials, known to those in the art, and embedded in an epoxy base. The protective layer or cleat is applied to upper and lower surfaces of a trailing element and can also be applied to the machine-direction pondside edges of the trailing element if desirable. The protective layer is compatible with the bonding and curing requirements of the composite sheets making up the trailing element.

Accordingly, a feature of the present invention is to provide an improved composite trailing element with reinforced edges which is capable of withstanding material handling problems which further reduces separation and delamination of the composite sheets making up the element.

Another feature of the present invention is to provide an improved composite trailing element which resists delamination between the composite plies of the element thereby increasing its field life expectancy.

Still another feature of the present invention is to provide an improved composite trailing element which resists delamination between the composite plies of the element thereby reducing flow disruption and machine runnability problems in a headbox.

These and other objects, features and advantages of the invention will become apparent to those skilled in the art upon reading the description of the preferred embodiments, in conjunction with the attached drawings.

DESCRIPTION OF THE PREFERRED EMBODIMENT

Figure 1:
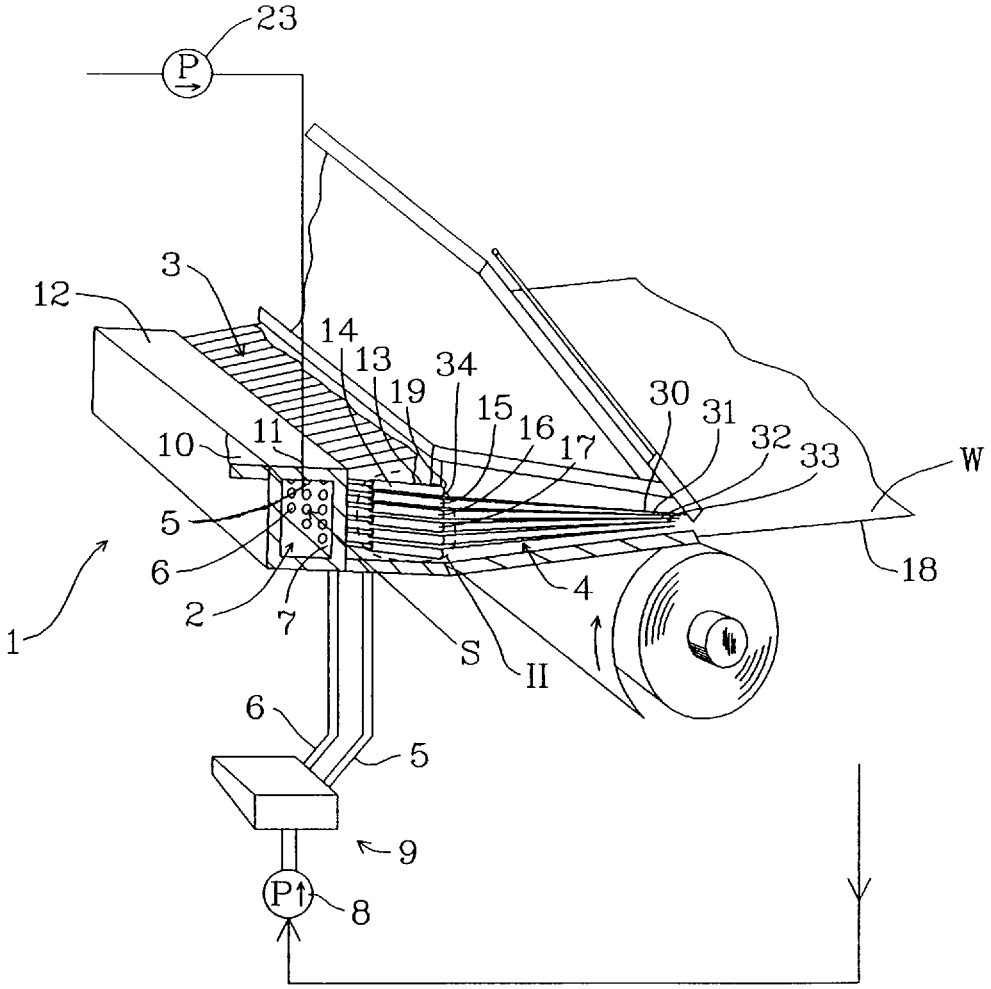
FIG. 1 is a perspective view of a headbox apparatus illustrating, among other components, trailing elements which embody the principals of the present invention.
Figure 4:
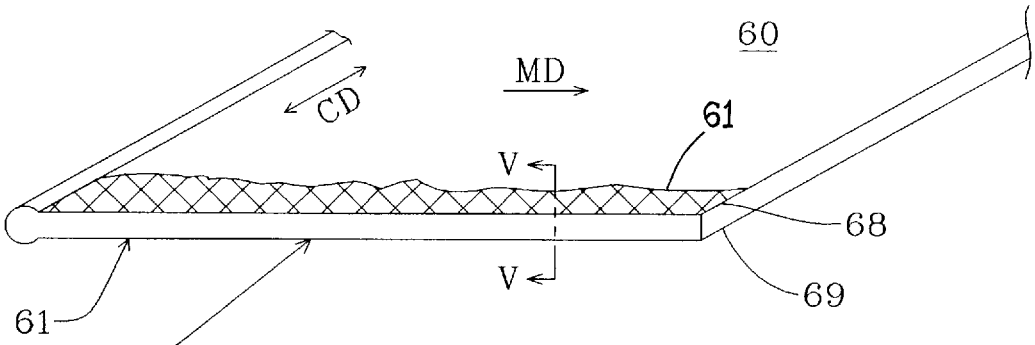
FIG. 4 is a further perspective view partially in section of the trailing element of FIG. 3 showing in detail the principals of the present invention.
Figure 5:
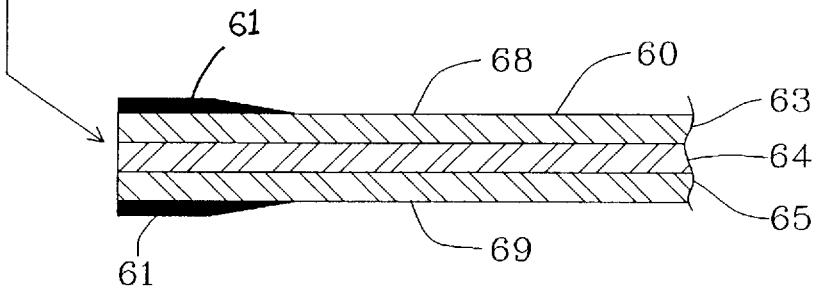
FIG. 5 is a sectional view taken along line V—V of FIG. 4, showing a trailing element according to the present invention.
Figure 6:
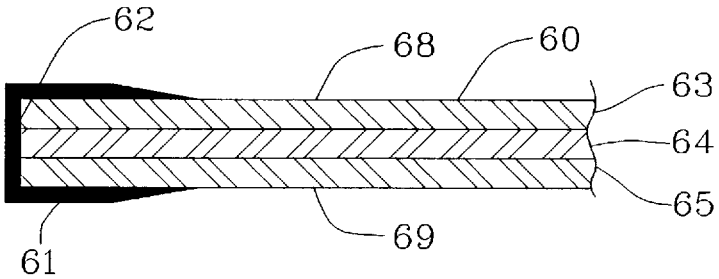
FIG. 6 is a sectional view of another embodiment of a trailing element according to the present invention.

Composite trailing elements shown in FIGS. 4, 5, and 6 according to the present invention can be used in a paper making machine headbox as shown in FIG. 1.

Shown in FIG. 1 is a perspective view of a headbox apparatus (1) using trailing elements according to the present invention for depositing stock (S) onto a forming wire (18) for forming a web (W). FIG. 1 is a perspective view of an inlet (2), a tube bank (3) and a slice chamber (4). As shown in FIG. 1, a plurality of supply conduits (5) and (6) are connected to an upstream end (7) of the tube bank (3). Each supply conduit (5) and (6) of the plurality of supply conduits are connected to a stock diluting source (8) for permitting dilution of stock (S) flowing into the tube bank (3). Control means, generally designated (9), cooperate with the supply conduits (5) and (6) for controlling the dilution of the stock (S) flowing through the tube bank (3) for controlling cross-machine directional basis weight of a resultant web. The inlet (2) may be tapered (not shown) in a cross-machine direction, such that the cross-sectional area for the flow therethrough of the stock progressively varies in a cross-machine direction.

A housing (10) includes an upstream and a downstream port (11) and (12), respectively, in fluid communication with the inlet (2). The upstream port (11) is connected to a pressurized source (23) of the stock (S). If the inlet (2) is of a tapered design, the cross-sectional area of the tapered inlet (2) is inversely proportional to a distance from the upstream port (11). It should be noted that the tapered inlet (2) can be of a parabolic-shaped design (not shown). Such a parabolic-shaped tapered header is capable of being designed to precisely match the theoretical shape needed for uniform pressure distribution across the width of the headbox (1).

The tube bank (3) also includes a frame (13) for mechanically supporting a plurality of tubes such as (14), (15), (16) and (17) such that the stock flowing through the inlet (2) and through the upstream end (7) of the tube bank (3) flows through the plurality of tubes. The plurality of tubes are arranged in vertically spaced parallel rows across the width of the headbox (1).

The slice chamber (4) includes a plurality of trailing elements such as (30), (31), (32) and (33). Each trailing element (30) to (33) has an upstream end (34) which is pivotally secured to a downstream end (19) of the tube bank (3). Each trailing element (30) to (33) is pivotally secured to the tube bank (3) between adjacent vertically spaced parallel rows of the plurality of tubes within the tube bank (3).

Figure 2:
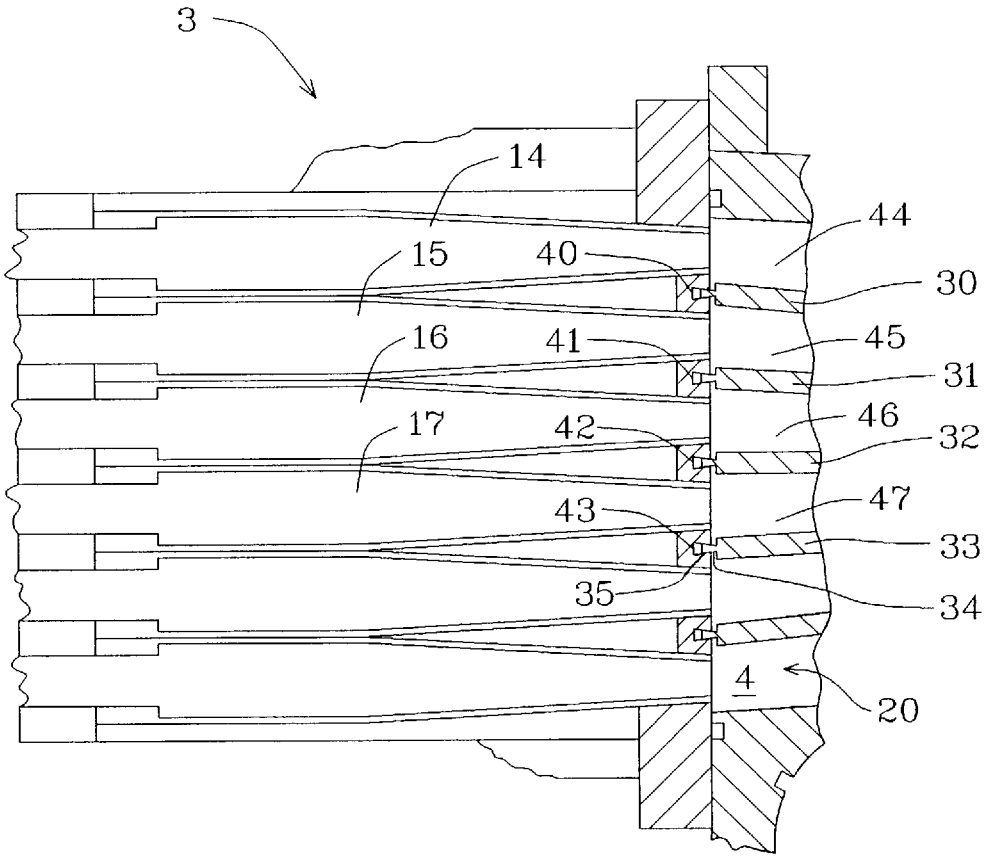
FIG. 2 is an enlarged perspective view represented by Circle II in FIG. 1 showing the relationship between the edge tubes and the trailing elements of the headbox of FIG. 1.

FIG. 2 is an enlarged perspective view of the tube bank (3) enclosed by circle II in FIG. 1 showing the tubes (14) to (17) and trailing elements (30) to (33). The tube bank (3) contains a plurality of dove-tail shaped grooves (40), (41), (42) and (43). Each groove (40) to (43) is disposed between adjacent vertically spaced parallel rows of the plurality of tubes. Each trailing element, for example, element (33), has in the vicinity of that trailing element's pivotally secured end (34) an enlargement (35) which cooperates with a mating groove, for example, groove (43), for pivotally anchoring the element (33) within the groove (43) such that the stock (S) flowing through an upstream extremity (20) of the slice chamber (4) is separated into a plurality of streams (44), (45), (46) and (47) partitioned from each other by the plurality of elements (30) to (33).

Figure 3:
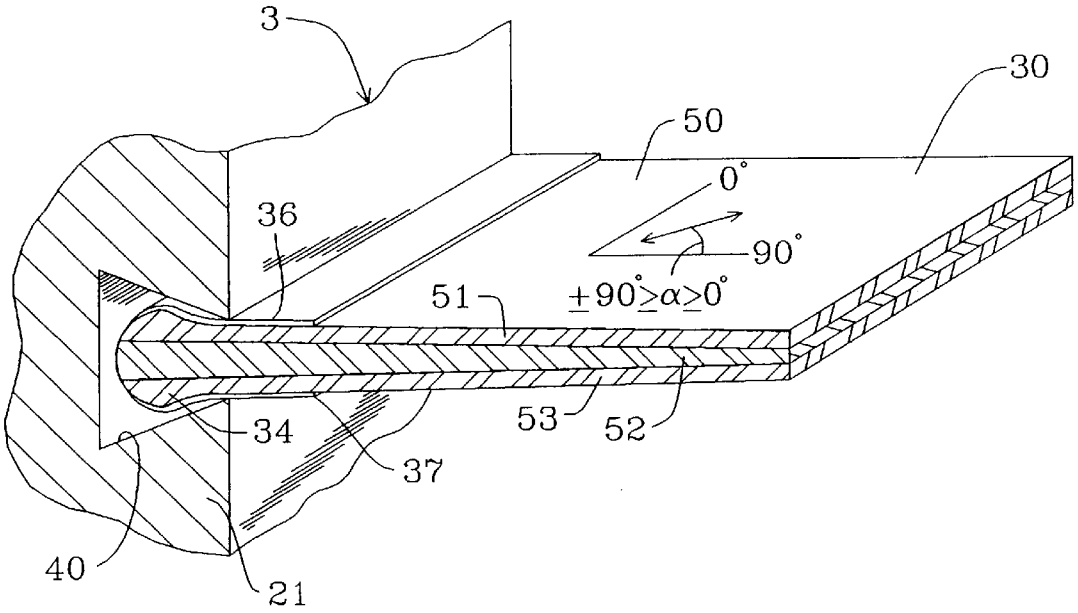
FIG. 3 is a perspective view partially in section of a trailing element of the headbox of FIG. 1.

One of the trailing elements of the trailing elements (30) to (33) of FIG. 1 is shown in detail in FIG. 3. The trailing element (30) has outer layers or sheets (51) and (53) and a centrally integrally sandwiched intermediate layer or sheet (52) therebetween. The upstream end (34) of the trailing element (30) is pivotally supported in a wall (21) of the tube bank (3). The upstream end (34) can take on the form of many different enlarged shapes such as, for example, a bulbous ridge as shown in FIG. 3. The upstream end (34) is pivotally mounted in a groove such as grooves (40), (41) (42) or (43) as shown in FIG. 2 and found in the wall (21) of the tube bank (3).

The sheets (51), (52) and (53) as shown in FIG. 3 are sometimes referred to as plies. As described in the '945 and '091 patents, the plies that comprise a trailing element are usually anisotropic in nature and have different strength and/or stiffness characteristics in different directions. The fibers of the plies can be oriented in the cross-machine direction or machine direction. In FIG. 3, directional lines are shown with a machine direction line shown at the 90 degree axis and the cross-machine direction shown at the zero degree axis and the intermediate direction shown by the double arrowed line with the angle between the double arrowed line and the machine directional line shown as a.

With reference to FIG. 3, as noted, the trailing element (30) includes sheets (51), (52) and (53) generally made from graphite fibers. The sheets (51) to (53) are of rectangular configuration when viewed from above, and are bonded together with an appropriate epoxy material well-known to those skilled in the art. It should be noted, that the sheets (51) to (53) can be staggered relative to each other such that the trailing element (30) is of a tapered configuration from the upstream end towards the downstream end, as described in U.S. Pat. No. 5,013,406 previously mentioned. In addition to bonding the plies or sheets together, the bonding means or epoxy resin is generally applied to the outer surfaces of sheets (51) and (53) for imparting smoothness to the trailing element (30). The trailing element (30) generally includes graphite fibers within the range 50 to 70 percent by weight, and epoxy resin within the range 30 to 50 percent by weight. Although only three sheets are shown in FIG. 3, it should be noted that typically, additional sheets are used to make up the element (30), as described in the '406 patent.

As described in U.S. Pat. No. 5,013,406, the trailing element (30), as shown in FIG. 3 hereof, further includes wear resistant means (36) and (37) applied to the upstream protrusion or bead (34) for inhibiting wear and fracturing of the sheet (51) and (53) caused by frictional engagement between trailing element (30) and the slot (40).

As described, generally, trailing elements consist of 0-degree or 90-degree or varying degree intermediate plies bonded together to form the final element. The plies are formed directly up to the pondside edge and trimmed to set the final cross-machine direction dimension. The number of plies and the machine direction length of each ply is determined for a specific application. The final trailing tip thickness is a critical parameter and is also set by selecting the number of plies in that area. The overall strength of a trailing element is derived from the combination of the base materials used. Additionally, strength from the epoxy resin and the graphite fibers each contribute to the overall strength of an element. While the graphite fibers are much stronger than the epoxy, they require the rigidity of the cured epoxy to result in the final structural strength.

The trailing elements described thus far are all part of the prior art. However, as noted, it has been found that these prior art trailing elements are faced with significant problems that cause the individual plies or sheets that make up each trailing element to delaminate. Delamination occurs when the epoxy used to bind the plies fails, this results in the individual plies beginning to separate. It has been found that the epoxy fails most often when the cross-machine direction edges of the plies are damaged. Such damage may result from impact damage during handling of the element or during operation if the edges of the element contact the pondside edges of the headbox. Additionally, damage may occur when the edges are trimmed to set the final cross-machine direction dimension of the element, as a result of the trimming and cutting operation, small cracks can be formed on the top and bottom surfaces of the trailing element. Because an element is made up of plies, once a tear is formed at the edges, the sheets have a tendency to rip and come apart. Once individual plies have separated, the strength of the entire structure is weakened as some of the load carrying capacity is greatly diminished. Although not a significant contribution to weakening the structure of a trailing element, it has been found that if stock or water finds its way between the sheets that make up an element, the element's overall strength may be reduced, as the stock or water sometimes breaks down the epoxy or resin used to hold the sheets together. If the element is not capable of carrying the designed load, the element will adversely affect the turbulence of the stock leaving the headbox which will result in a poor final paper product. Additionally, any rough area caused by delaminated sheets in the headbox or approach flow system can catch individual paper fibers. Once fibers adhere to these rough areas, the fibers tend to catch other fibers and form lumps of fibers. These lumps will grow until they eventually break free and exit the headbox in the web being formed. Once these lumps are in the forming paper web, this type of defect will likely cause the sheet to break in the press section, early dryer section or size press of a paper making machine. Once the sheet breaks, of course, the machine must be re-thread and thus hurting efficiency. Additionally, lumps of the type described can also cause damage to press belts or felts, roll covers, dryer felts, etc.

It should be noted that the edges of an element in the machine direction are sometimes sealed by the same epoxy used to bond the plies of an element together in order to superficially protect the edges from damage and hamper stock or water absorption between the graphite composite sheets. Nevertheless, it has been found through field operation and observation that when an epoxy or sealant has been applied to the edges of an element, the epoxy or sealant is not capable of protecting the edges from the damage and detrimental effects described herein and does not maintain a seal to prevent stock or water from being absorbed between the sheets of the element.

To combat these problems, a trailing element is provided which is constructed so as to substantially reduce the effect of damage on the edges to which current trailing elements are often subjected.

Installation of trailing elements is a time consuming and somewhat cumbersome procedure. As is generally known, a trailing element like element (30), as shown in FIG. 3, with its bulbous end (34) is manually slid into its mating dovetail holding slot (40) for operation. A trailing element is a rather rigid, continuous large plate which is difficult to handle and, as a result, takes many people to handle. Depending on the width of a paper machine headbox, such elements may be from about 100–400 inches wide in the cross-machine direction, 15–30 inches long in the machine direction and 0.015–0.150 inches thick and typically weigh 50–150 pounds. In order to insert such a large element into its appropriate mating slot, the element must be slid into the headbox slot while held at the proper elevation and alignment. Additionally, as can be appreciated, there are frictional forces to overcome when installing or removing an element. Considering the cumbersomeness of an element and the installation process, it is fairly easy for those installing an element to have the edges of the element strike something during installation and be damaged.

Once installed, during operation, each element is only restrained by its mating slot formed in the tube bank of the headbox. Friction is the only other means by which the cross-machine direction position of an element is set, other than the original position of the element as determined by those installing the element. Since the elements are slightly narrower than the headbox, to be properly installed, the elements should be centered between the pondsides. If the elements are not properly centered or installed, or if any fluid forces overcome the frictional forces, it is possible for the sheets to contact the pondsides and be damaged.

If the edges of the elements are damaged, the epoxy holding the plies together fails and the sheets begin to separate causing the problems heretofore mentioned.

A trailing element (60), as shown in FIGS. 4 and 5, according to the present invention, solves the aforementioned problems. The trailing element (60) has the same plies and upstream end that are found in the prior art elements. What is not found in the prior art elements is the protective layer or cleat (61) applied to the cross-machine direction upper (68) and lower (69) edges of the element (60). The protective layer (61) can be made from any number of woven fiber glass mesh materials, known to those in the art, which fiber glass mesh material is embedded in an epoxy that is compatible with the bonding and curing requirements of the composite sheets making up the trailing element (60). The protective layer (61) is applied to the cross-machine direction upper (68) and lower (69) edges of the element (60) as can best be observed in FIG. 5. The protective layer (61) reinforces the cross-machine direction upper (68) and lower (69) surfaces of the trailing element (60) to protect the edges from damage so as to reduce delamination of the composite sheets (63) to (65) making up the overall element (60). The protective layers or cleats can be applied to the surfaces of the element before or after the cross-machine directional width of the element is set.

The addition of the extra protective layer (61) at the edges (68) and (69) offers protection from the type of handling damage previously described. Reinforced upper and lower surfaces of an element will substantially prevent the sheets or plies from separating if the edges of the element are damaged. Moreover, reinforced surfaces will substantially prevent the sheets or plies from ripping or tearing apart as a result of small cracks formed in the element when the element is trimmed to cross-machine directional width.

FIG. 6 shows a trailing element that is like the trailing element described in FIGS. 4 and 5 in all aspects but one; the machine direction edges (62) are also covered by the extra protective layer (61). As shown in FIG. 6, the entire pondside edge of the element (60) is covered with the protective layer (61).

As previously noted, the edges of prior art trailing elements constructed of individual plies bonded together, like those shown in FIGS. 1, 2 and 3 and described in the above-mentioned prior art patents, have been sealed by the same epoxy resin that is used to bind all of the plies together. However, as noted, through field observation, it has been determined that this sealing means is not satisfactory. First, this sealing means does not protect the edges of a trailing element from damage associated with handling or operational problems. As such, once damaged, this sealing means does not prevent the sheets of the trailing element from separating which causes all of the problems heretofore mentioned. Second, at times the epoxy resin is unable to withstand direct exposure to the pulp/water mixture traveling through a headbox. The paper stock mixture may contain chemicals that breakdown the epoxy resin if the epoxy resin is exposed to the chemicals. Once water is absorbed between the plies, it may facilitate the breakdown of the epoxy holding the sheets together and the sheets may begin to separate resulting in the hereinabove mentioned problems.

While a composite trailing element which is less susceptible to delamination and has a longer usable life than heretofore known has been shown and described herein, various changes may be made without departing from the scope of the present invention. For example, the protective layer or cleat of the present invention may be applied to the entire outer surface area of a trailing element.

We claim:

1. A trailing element for a paper machine headbox, said trailing element comprising:

a plurality of composite sheets, said sheets having front and back machine direction edges;

bonding means cooperating with said plurality of sheets for bonding said sheets together to form said trailing element, said trailing element designed to be disposed within the headbox, said trailing element having cross-machine direction upper and lower surfaces, said trailing element further having front and back pondside edges; and upper and lower protective cleats, said upper protective cleat applied to the cross-machine direction upper surface of said trailing element and said lower protective cleat applied to the cross-machine direction lower surface of said trailing element, said protective cleats thereby reinforcing the pondside edges of said element to protect said edges from damage in order to substantially prevent said composite sheets from delaminating and to further substantially prevent the overall element from tearing.

2. A trailing element as recited in claim 1 wherein said plurality of composite sheets include graphite fibers.

3. A trailing element as recited in claim 2 wherein said bonding means is an epoxy resin.

4. A trailing element as recited in claim 3 wherein said plurality of composite sheets are of rectangular configuration.

5. A trailing element as recited in claim 1 wherein said plurality of composite sheets are staggered relative to each other such that said trailing element is of a tapered configuration, said trailing-element tapering from the upstream end towards the downstream end.

6. A trailing element as recited in claim 2 wherein said upper and lower protective cleats are of a woven fiber glass mesh material embedded in an epoxy resin, the epoxy resin being the same type of epoxy resin used to bind said plurality of composite sheets.

7. A trailing element as recited in claim 1 wherein said upper and lower protective cleats are of a woven fiber glass mesh material embedded in an epoxy resin.

8. A trailing element as recited in claim 1 wherein said upper and lower protective cleats extend around said front and back machine direction edges of said bonded plurality of sheets forming a protective layer around said edges, thereby encasing said edges of said plurality of bonded sheets thus preventing said edges from being directly exposed to stock and water flowing through the headbox such that the stock and water are prevented from being absorbed through said edges of said plurality of sheets making up said element to protect said sheets from delamination, said protective layer further reinforcing said edges thereby protecting said edges from damage associated with handling of said trailing element in order to further protect the edges from delamination.

9. A trailing element as recited in claim 8 wherein said protective layer extends around the entire outer surface area of said trailing element.

* * * * *